US010245196B2

(12) United States Patent
Doppler et al.

(10) Patent No.: US 10,245,196 B2
(45) Date of Patent: Apr. 2, 2019

(54) ADJUSTING DEVICE FOR A HEIGHT-ADJUSTABLE PLATFORM AND METHOD FOR ADJUSTING THE HEIGHT OF THE PLATFORM

(71) Applicants: Manuel Doppler, Wehr (DE); Klaus Pfeffer, Schopfheim (DE); Marcel Soltermann, Sankt Pantaleon (CH); Tobias Tschabold, Pratteln (CH)

(72) Inventors: Manuel Doppler, Wehr (DE); Klaus Pfeffer, Schopfheim (DE); Marcel Soltermann, Sankt Pantaleon (CH); Tobias Tschabold, Pratteln (CH)

(73) Assignee: Aktiebolaget SKF, Göteborg (SE)

( * ) Notice: Subject to any disclaimer, the term of this patent is extended or adjusted under 35 U.S.C. 154(b) by 491 days.

(21) Appl. No.: 14/722,728

(22) Filed: May 27, 2015

(65) Prior Publication Data

US 2016/0015582 A1 Jan. 21, 2016

(30) Foreign Application Priority Data

May 28, 2014 (DE) ..... 10 2014 210 250

(51) Int. Cl.

| | |
|---|---|
| ***B66F 7/14*** | (2006.01) |
| ***A61G 13/06*** | (2006.01) |
| ***A61G 7/012*** | (2006.01) |
| ***A61G 7/018*** | (2006.01) |

(52) U.S. Cl.

CPC ..... *A61G 7/012* (2013.01); *A61G 7/018* (2013.01); *A61G 13/06* (2013.01); *B66F 7/14* (2013.01)

(58) Field of Classification Search

CPC ..... A61G 7/002; A61G 7/012; A61G 7/018; B66F 3/16; B66F 7/10; B66F 7/12; B66F 7/14

See application file for complete search history.

(56) References Cited

U.S. PATENT DOCUMENTS 1,009,186 A * 11/1911 Sargent ..... B66F 7/14 254/92
1,018,127 A * 2/1912 Olson ..... B66F 7/14 254/92
1,096,316 A * 5/1914 Noble ..... A47D 7/03 5/11

(Continued)

FOREIGN PATENT DOCUMENTS

CN 2770625 Y 4/2006
CN 101922520 A 12/2010

(Continued)

OTHER PUBLICATIONS

Chinese Office Action dated Jun. 20, 2018 , CN Application No. 201510495692.6, 9 pages.

*Primary Examiner* — Tyrone V Hall, Jr.
(74) *Attorney, Agent, or Firm* — Bryan Peckjian; SKF USA Inc. Patent Dept.

(57) ABSTRACT

The height of a platform relative to a support surface is adjustable by rotating a drive shaft to actuate a first height-adjusting device and a second height-adjusting device, thereby changing the height of the respective ends of the first and second height-adjusting devices relative to the support surface. The drive shaft is selectively drivable by either a drive motor or a manually-operable drive.

14 Claims, 4 Drawing Sheets

(56) References Cited

U.S. PATENT DOCUMENTS

| | | | | | |
|---|---|---|---|---|---|
| 1,176,751 | A * | 3/1916 | Hardy et al. | B66F 7/14 | 254/100 |
| 2,522,759 | A * | 9/1950 | Lindquist | A61G 7/005 | 5/610 |
| 2,870,460 | A | 1/1959 | Sanford | | |
| 4,405,116 | A * | 9/1983 | Eisenberg | B66F 7/0608 | 182/141 |
| 5,269,031 | A * | 12/1993 | Alexander | A47C 20/041 | 192/48.2 |
| 5,337,627 | A * | 8/1994 | Nakamura | F16H 25/2204 | 74/424.76 |
| 6,000,076 | A * | 12/1999 | Webster | A61G 7/015 | 5/600 |
| 2012/0084921 | A1 * | 4/2012 | Serhan | A47C 19/045 | 5/610 |

FOREIGN PATENT DOCUMENTS

| | | | |
|---|---|---|---|
| CN | 103126841 | A | 6/2013 |
| DE | 1168014 | A | 4/1964 |
| DE | 1182408 | A | 11/1964 |
| DE | 2626638 | A1 | 12/1977 |
| DE | 69727882 | T2 | 7/2004 |
| DE | 102004016728 | A1 | 10/2005 |

* cited by examiner

ADJUSTING DEVICE FOR A HEIGHT-ADJUSTABLE PLATFORM AND METHOD FOR ADJUSTING THE HEIGHT OF THE PLATFORM

CROSS-REFERENCE TO RELATED APPLICATION

This application claims priority to German patent application no. 10 2014 210 250.2 filed on May 28, 2014, the contents of which are fully incorporated herein by reference.

TECHNICAL FIELD

Exemplary embodiments relate to an adjusting device for a height-adjustable platform, for example a patient table, and a method for changing the height of the platform, for example, a patient table.

BACKGROUND

Height-adjustable platforms are used in widely-differing applications. For example, the platform can be loaded and/or unloaded at a first height. At another height, an item (object) or a person that or who lies on the platform can be treated, inspected, and/or examined. Such platforms can be used in medical applications, for example, as couches, tables, patient tables, or the like. Due to the height-adjustability of the platform, a patient, for example, can be brought to a height at which the patient can be treated, transferred to another platform or table and/or can also leave the platform again. A variety of adjusting devices can be used to adjust the height of the platform.

In addition to the need to make possible a precise and exact height adjustment, such adjusting devices for a height-adjustable platform or a method for adjusting the platform are subject to a whole series of further requirements, for example, with respect to low vibration, low noise development, and high reliability.

SUMMARY

Exemplary embodiments relate to an adjusting device for a height-adjustable platform (also referred to as a table, tray, shelf, plank, board, planar structure, etc.), for example a patient table, which comprises at least one drive motor configured to change the height of the adjusting device. The adjusting device further comprises a drive shaft configured to change the height of a first height-adjusting device and the height of a second height-adjusting device. Thus in some exemplary embodiments a particularly robust and stable adjusting device can be provided. The height adjustment can potentially be effected particularly uniformly. This can be important, for example, when examining, treating or operating on patients.

The drive shaft can be disposed, for example, perpendicular to the two height-adjusting devices. In certain circumstances the drive shaft can be disposed parallel to a platform, on which, for example, a patient lies, and/or parallel to a plane whose height is adjusted using the adjusting device. The drive shaft can be disposed, for example, along its main extension parallel to a main extension of the adjusting device or along a longitudinal extension of the adjusting device. In certain circumstances the drive shaft can drive a height-adjusting device using each end.

Furthermore, in some exemplary embodiments the adjusting device can also comprise at least one manual drive, which is also configured to change the height of the adjusting device. In certain circumstances the manual drive can also be configured to drive the drive shaft, or to rotate it about an axis of rotation. The manual drive can potentially also be omitted.

According to a further aspect, exemplary embodiments relate to a method for changing the height of a platform, for example, of a patient table, wherein a motor-driven adjusting of the height of the platform is effected by a drive motor. For this purpose two height-adjusting devices can potentially be simultaneously adjusted via one drive shaft. In certain circumstances the changing of the height of the platform can also be effected by a manual drive. For this purpose, in certain circumstances the manual drive can also drive the drive shaft.

Since the adjusting device includes a manual drive and a drive motor to change the height of the adjusting device, in some exemplary embodiments it can be made possible that the height of the platform potentially can be adjusted by the manual drive during a power outage or if the drive motor does not function. This can be important, for example, in cases when a patient lies on the platform who is unable to move or is limited in his movement, to make possible a safe getting-on and/or -off. Nevertheless, in a normal process operation, the comfort of an automatic or motor-driven height-adjustment can be used to change the height without the operator having to expend energy.

The drive motor can be, for example, an electric- and/or a hydraulic-motor. Thus in some exemplary embodiments the drive motor can be configured in a particularly low-noise manner.

Additionally or alternatively, in some exemplary embodiments the manual drive is configured to be friction-fit- and/or interference-fit-coupled to the adjusting device, wherein the friction-fit and/or interference-fit is separable. In some exemplary embodiments it can thus be made possible that the manual drive or its individual components are not also moved when the adjustment is provided by the drive motor. It can thereby be prevented, for example, that additional vibrations are coupled into the adjusting device by the manual drive or its components. In some exemplary embodiments the adjusting device can thus be configured in particularly low-vibration manner. This can, for example, increase the comfort during an adjusting of a platform, above all for a person who lies on the platform. Furthermore, in some exemplary embodiments it can thus also be made possible that no additional noise is generated by moving of the components of the manual drive when the height adjustment is effected by the drive motor. A lowest-possible-noise operation of the adjusting device or an adjusting of the platform can thus be achieved, if necessary. Above all, when treating or examining a patient, but also with other uses, a particularly low-noise operation can be desired.

Additionally or alternatively, in some exemplary embodiments the adjusting device comprises a retaining device, which is configured to separate the friction-fit. In certain circumstances, in some exemplary embodiments a separating of the friction-fit can thus be ensured in a simple manner. The desired noise- and vibration-reduction can thereby also potentially be achieved during a motor operation.

For example, the retaining device can comprise a spring element, which preloads the manual drive such that the friction-fit and thus potentially also an interference-fit between the elements, which can be for transmitting the torque in an interference fit, is separated. In some exemplary embodiments it can thus be ensured that the friction fit is reliably separated without the intervention of an operator.

Optionally the adjusting device can comprise a spring element, which is configured to preload the manual drive such that a friction-fit arises between the manual drive and the adjusting device in order to change the height of the adjusting device. Thus in some exemplary embodiments it can be made possible that, when an actuation of the adjusting device is to occur via the manual drive, the friction-fit between the manual drive and the adjusting device occurs via the spring element and need not be additionally generated by an operator who rotates the manual drive. In some exemplary embodiments the operating of the manual drive can thereby be designed as comfortable as possible for the operator.

In such exemplary embodiments the retaining device can be configured, for example, as a latch or interlock. In some exemplary embodiments it can thus be made possible that a friction-fit between the adjusting device and the manual drive is actually disconnected in a reliable manner when it is not desired.

In some further exemplary embodiments the manual drive is configured to enter into engagement with a drive shaft of the adjusting device in order to transmit a torque to the drive shaft. For example, for this purpose the manual drive can enter directly into contact with the drive shaft. A direct contact can occur, for example, at an unchanged rotational speed, i.e. without interposing of a transmission and/or of a gear wheel. The manual drive can possibly include a gear that rotates at the same rotational speed at which the manual drive is rotated by an operator. This gear can engage, for example, in a gear that is attached to the drive shaft for rotation therewith. In some exemplary embodiments it can thus be made possible that the manual drive engages on the same element of the adjusting device as the drive motor. In some further exemplary embodiments the drive shaft is configured to change, via at least one transmission, the length of a height-adjusting devicen that is adjustable in its length. For example, in adjusting devices wherein a plurality of height-adjusting devices are driven via the drive shaft, the manual drive can replace the torque of the drive motor. Additionally or alternatively, in such exemplary embodiments the manual drive can also be disposed directly on the height adjusting device. For example, in adjusting devices wherein a plurality of height-adjusting devices are driven via the drive shaft, the manual drive can thus replace the drive motor in a substantially equivalent manner.

In some exemplary embodiments, an axis of rotation of the manual drive is disposed at an angle of substantially 90° to the drive shaft, for example, at an angle of 75° to 105°. Thus in certain circumstances it can be made possible that an operating of the adjusting device is possible for an operator via the manual drive from a similar position as during an operation via the electric drive. For example, for this purpose the operator can also stand on a long side of the platform, under which the adjusting device is disposed, and along which the drive shaft extends. In cases wherein a patient lies on the platform, the operator, although he must operate the manual drive, can assume an identical or similar position as during an adjusting via the drive motor. For example, a control element for the drive motor can be located in the vicinity of the manual drive. For assembly and/or manufacturing reasons, due to space conditions or for other reasons an angle of substantially 90° here can also deviate from a 90° angle by an angle between 0° and 15° in any direction.

In certain circumstances the manual drive can have a shorter length along its axis of rotation than the drive shaft along its axis of rotation. In certain circumstances the drive shaft and/or a length of the platform can be longer by at least 50%, 60%, 70%, 80%, 90%, 100%, 110%, 120%, 130%, 140%, 150%, 160%, 170%, 180%, 190%, 200%, or 210% than the manual drive. In some exemplary embodiments this can lead to a very stable construction.

Additionally or alternatively, in some exemplary embodiments the manual drive includes a gear, which is configured to be at least temporarily in engagement with a gear of the drive shaft, so that a torque from the manual drive is transmissible to the drive shaft. Optionally the manual drive can comprise a bevel gear, which is configured to at least temporarily mesh with a bevel gear of the drive shaft, so that a torque is transmissible from the manual drive to the drive shaft. In some exemplary embodiments a reliable torque transmission from the manual drive to the adjusting device can be made possible either by the gear or the bevel gear.

Exemplary embodiments also relate to a platform that is height-adjustable, for example, a patient table including an adjusting device according to at least one of the exemplary embodiments and a platform plate wherein the adjusting device is configured to change the position of the platform plate relative to the surface on which the platform stands.

Additionally or alternatively, in some exemplary embodiments the manual drive is supported on the platform or on components of the platform. For example, the manual drive can thus be preloaded in a simple manner with respect to the adjusting device, or a friction-fit between the manual drive and the adjusting device can be separated. Furthermore, for example, accessibility of the manual drive can thereby be simplified. Thus an operation of the manual drive can be improved or designed so as to be as comfortable as possible.

In some exemplary embodiments the manual drive is supported on a transverse strut of the platform or on a transverse strut that connects legs or feet of the platform or of a patient table.

The exemplary embodiments and their individual features disclosed in the above description, the following claims, and the accompanying Figures can be meaningful and implemented both individually and in any combination for the realization of an exemplary embodiment in its various designs.

DETAILED DESCRIPTION

In the following description of the accompanying Figures, like reference numbers refer to like or comparable components. Furthermore, summarizing reference numbers are used for components and objects that appear multiple times in an exemplary embodiment or in an illustration, but that are described together in terms of one or more common features.Components or objects that are described with the same or summarizing reference numbers can be embodied identically, but also optionally differently, in terms of individual, multiple, or all features, their dimensions, for example, as long as the description does not explicitly or implicitly indicate otherwise.

Figure 1:
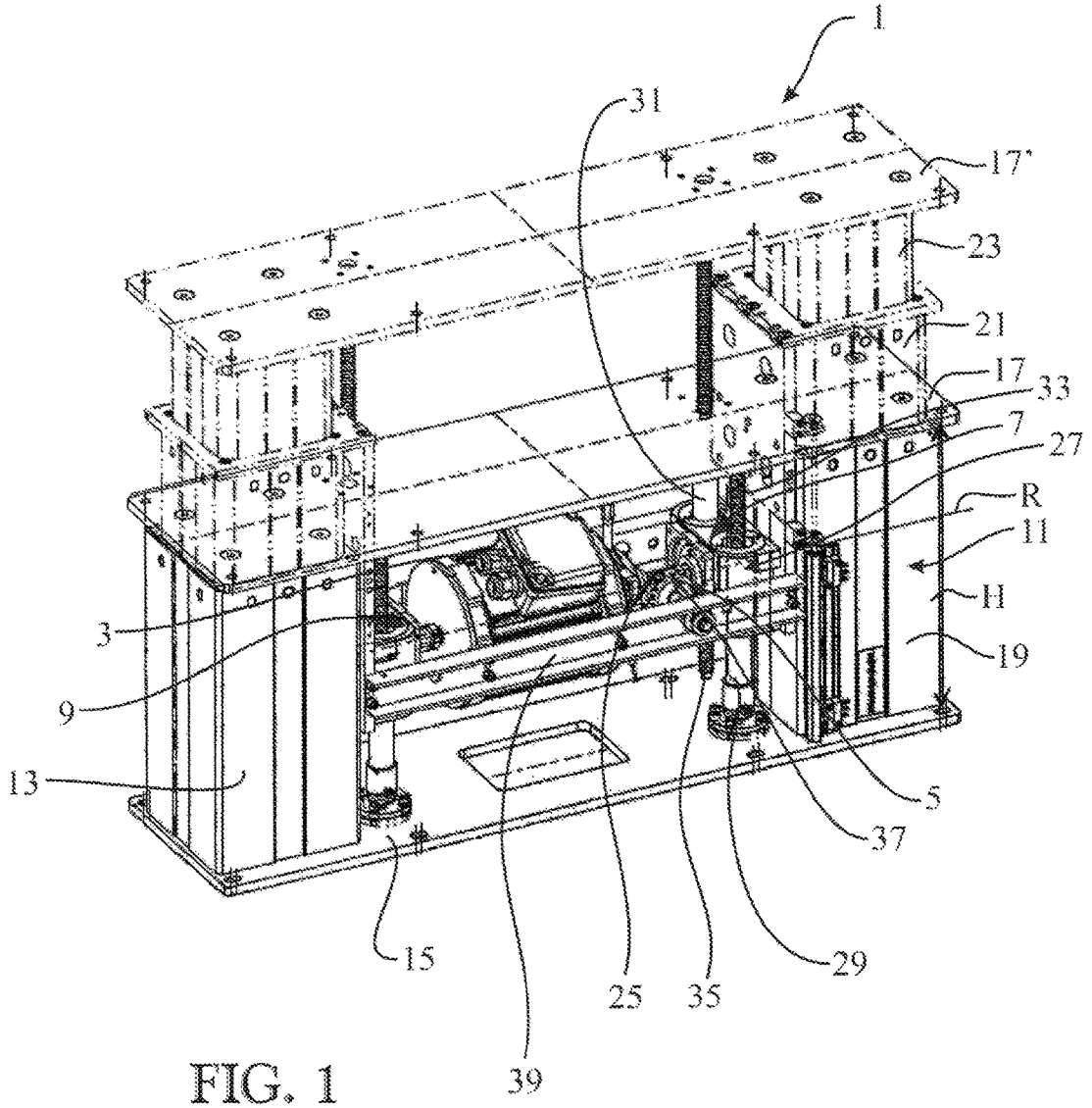
FIG. 1 shows a schematic depiction of a perspective view of an adjusting device according to an exemplary embodiment
Figure 2A:
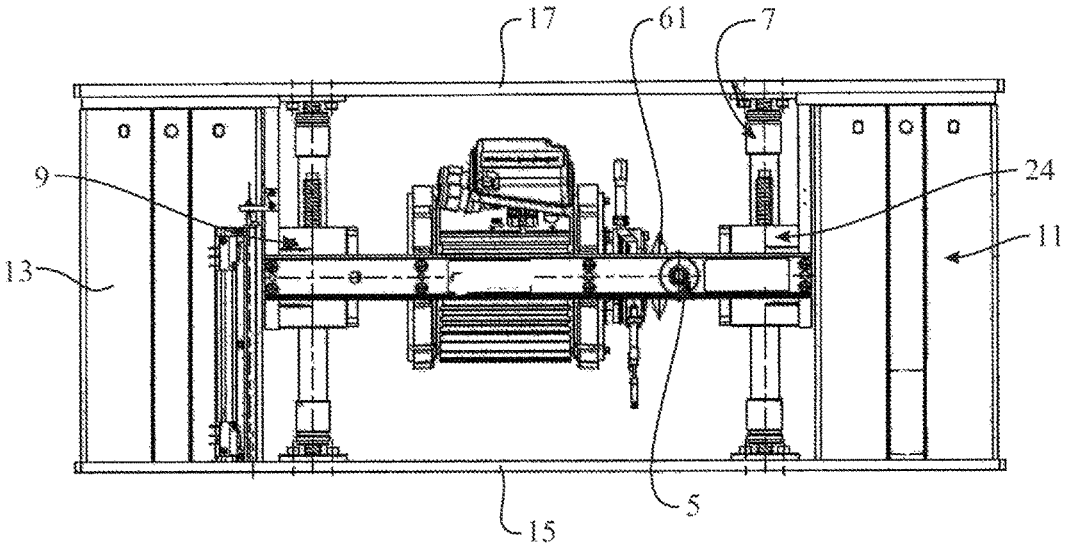
FIG. 2A shows a schematic depiction of a side view of the adjusting device according to FIG. 1.

FIGS. 1 to 2A show different depictions of an adjusting device 1 for a height-adjustable platform, for example a patient table. The adjusting device 1 comprises at least one drive motor 3, which is configured to change the height H of the adjusting device 1. The adjusting device 1 also further comprises a manual drive 5, which is configured to change the height H of the adjusting device 1.

In some further, not-depicted exemplary embodiments the manual drive can also be omitted.

Here a height H of the adjusting device 1 can be an extension of the adjusting device 1 perpendicular to a base or a surface on which the adjusting device 1 stands.

The manual drive 5 as well sa the drive motor 3 can drive a drive shaft 25 such that the drive shaft 25 rotates about an axis of rotation R. The drive motor 3 can be, for example, an alternating-current motor. The drive shaft 25 is disposed perpendicular to a direction, i.e., the height H, in which the adjusting device 1 can be adjusted. A height-adjusting device 7 can be driven or changed in its height via the drive shaft 25. In the exemplary embodiment of the Figures, the adjusting device 1 also comprises a second height-adjusting device 9 in addition to the first height-adjusting device 7. Each of the height-adjusting devices 7 and 9 is disposed on an opposite end of the drive shaft 25. In the exemplary embodiment of the Figures, the height-adjusting devices 7 and 9 each have two mutually-opposingly disposed ball screws. The adjusting device 1 thus comprises four ball screws. In some further, not-depicted exemplary embodiments the height-adjusting devices can also comprise other linear drives or linear guides.

Furthermore, the adjusting device 1 also comprises a first guide structure 11 and a second guide structure 13. The two guide structures 11 and 13 are disposed outside the two height-adjusting devices 7 and 9 in the direction of the axis of rotation R. The two guide structures 11 and 13, as well as the two height-adjusting devices 7 and 9, are each connected to a base plate 15 as well as to a platform plate 17. In FIG. 1 the platform plate 17 in a driven-out state is indicated by reference number 17' and depicted in a dash-line manner. The platform plate 17 serves, for example, for attaching or receiving of a bed surface or receiving surface for a patient or an object, who or which is to be received on the platform. The base plate 15 is disposed on the surface whereon the adjusting device 1 stands. The platform plate 17 is disposed substantially parallel to the base plate 15. In the present exemplary embodiment the base plate 15 and the platform plate 17 have similar dimensions. In some further, not-depicted exemplary embodiments the base plate and the platform plate can also have different dimensions.

The guide structures 11 and 13 serve to guide and stabilize an adjusting movement by the height-adjusting devices 7 and 9, and include no drive themselves. The guide structures 11 and 13 are each similarly-constructed, telescopically-movable columns. Therefore in the following only the guide structure 11 is described in more detail. The guide structure 11 comprises three tubes 19, 21, and 23, which each have a rectangular cross-section. The tube 19 having a largest cross-section is connected to the base plate 15. The tube 21 having a medium cross section is movably disposed and guided in the direction of the height H in the tube 19 having the largest cross-section. In the tube 21, a further tube 23 having a smallest cross-section is also movably disposed and guided in the direction of the height H. The tube 23 having the smallest cross-section is connected to the platform plate 17. Due to the cross-section shape, the tubes 19 to 23 cannot rotate relative to one another. The two guide structures 11 and 13 can also be referred to as two telescopic columns, each including three cylindrical-shaped pullout segments, which comprise aluminum as the material. In some further, not-depicted exemplary embodiments the adjusting device can also comprise no guide structures, only one guide structure, or another type of guide structure, for example, a different linear guiding unit. Optionally the adjusting device can also comprise a different number and/or type of height-adjusting devices, for example, a lead screw, a cylindrical screw, or the like.

The height-adjusting device 7 is configured substantially analogously to the height-adjusting device 9 and is also driven by the drive shaft 25 in an analogous manner. Therefore in the following only the height-adjusting device 7 is described in more detail. The height-adjusting device 7 comprises, as components of the already-mentioned ball screw, two hollow shafts 29 and 31, which each comprise not-depicted gear wheels. These are located in the transmission 27, which can also be referred to as the gearbox. The drive shaft 25 engages with a corresponding gear in the gear wheels on the hollow shafts 29 and 31 in order to transmit a drive movement of the drive shaft 26 to the hollow shafts 29 and 31. Here the rotational movement is redirected by 90°. The rotational speed is maintained. Here an amplifying (increasing) or reducing of the rotational speed can also optionally be effected.

A threaded rod 33 is disposed in the hollow shaft 29 concentric to the hollow shaft 29, which is in engagement with the hollow shaft 29 via a not-depicted nut. The threaded rod 33, which can also be referred to as the spindle, can be moved out of the hollow shaft 29 in the direction of the height H or can be sunk further in the hollow shaft 29 by a rotational movement of the hollow shaft 29. The threaded rod 33 pushes against the platform plate 17. The threaded rod 33 is connected to the base plate 15 and platform plate 17 via a connector. A threaded rod 35 is also analogously disposed in the hollow shaft 31. It protrudes out of the hollow shaft 31 so that it can be in contact with the base plate 15. As was described for the threaded rod 33 and the hollow shaft 29, the threaded rod 35 can be moved out of the hollow shaft 31 or sunk further therein by a rotational movement of the hollow shaft 31. If the threaded rods 33 and 35 are moved out of the hollow shafts 29 and 31, and the corresponding threaded rods of the height-adjusting device 9 are moved out of their hollow shafts 29 and 31, they raise the platform plate 17. With the counter-movement, the platform plate 17 is lowered.

The drive shaft 25 includes a coupling 37 between the drive motor 3 and each of the adjusting device 7 and 9, respectively, or the corresponding transmissions. The couplings 37 can provide, for example, a reliable connection and torque transmission. In addition, the coupling serves to eliminate deviations between the motor shaft and the transmission shaft. In the exemplary embodiment of the Figures, each coupling 37 comprises two half-shell coupling elements. In some further, not-depicted exemplary embodiments, the coupling can also be configured in another manner, or can be omitted.

Figure 2B:
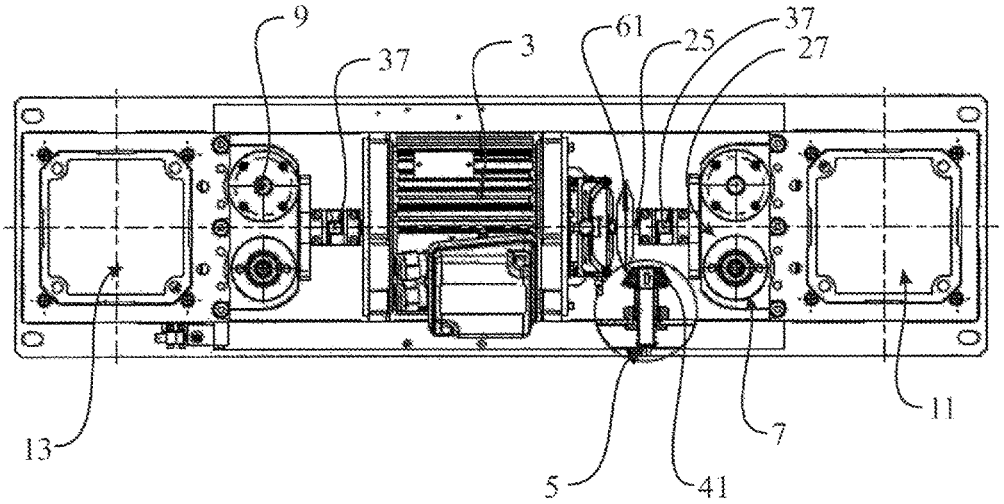
FIG. 2B shows a schematic depiction of a plan view of the adjusting device according to FIGS. 1 and 2A.
Figure 2C:
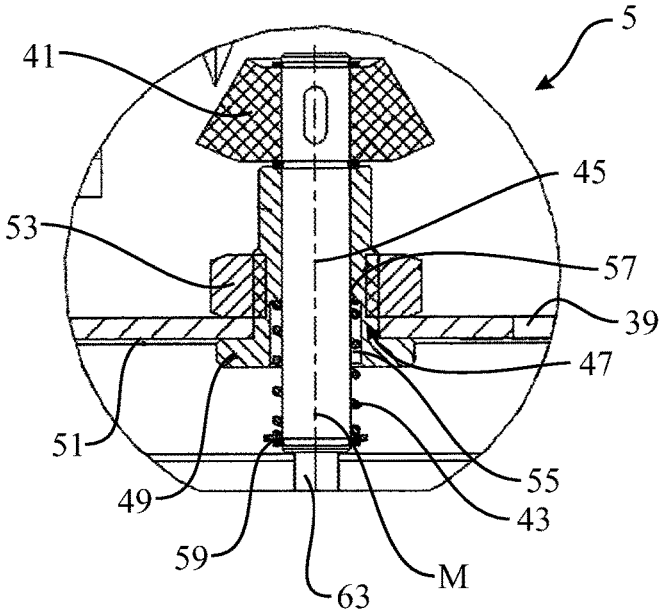
FIG. 2C shows an enlarged detail of FIG. 2B.

FIG. 2C shows an enlarged detail of FIG. 2B including the manual drive 5. In FIG. 2B the platform plate 17 is not depicted to improve clarity. The manual drive 5 is configured to be coupled to the adjusting device 1 or to the drive shaft 25. A mechanical coupling of two components encompasses both a direct and an indirect coupling. In the exemplary embodiment of the Figures, the manual drive 5 comprises a bevel gear 41 as a gear, which is configured to be friction-fit coupled with the drive shaft 25 and thus to the adjusting device 1. With a friction-fit coupling or the producing of a friction-fit, a coupling, for example, of two components can be understood such that a flow of forces and/or a torque can be transmitted. This can be effected via different transmission- and/or coupling-mechanisms. For example, for this purpose the two components can be in interference-fit engagement with each other, like gear wheels. The manual drive 5 also comprises a manual drive shaft 45. In some further, not-depicted exemplary embodiments, the manual drive can also include another gear or another gear wheel that is configured to enter into engagement with the drive shaft. Furthermore the adjusting device 1 and the manual drive can also be coupled via other and/or additional components.

The bevel gear 41 is connected to the manual drive shaft 45 so as to rotate therewith. Without actuation, for example, by an operator, the manual drive 5 is disposed without friction-fit with respect to the drive shaft 25. For this purpose the manual drive 5 is supported on a transverse strut 39 of the platform or of the adjusting device 1 and preloaded by a spring element 43 such that a friction-fit between the bevel gear 41 and the drive shaft 25 is separated. In some further, not-depicted exemplary embodiments, the manual drive can also be supported on another component of the adjusting device.

The manual drive shaft 45 is disposed in a shaft 47. The shaft 47 includes a bore in which the manual drive shaft 45 is concentrically received. The shaft 47 further includes a flange 49 on an end that is disposed opposite to the bevel gear 41. The shaft 47 abuts with the flange 49 on an outer side 51 of the transverse strut 39. Here the side of the transverse strut 39 is indicated by the outer side 51, which faces away from the drive motor 3 and the drive shaft 25. The shaft 47 engages through a bore in the transverse strut 39. The shaft 47 is attached to the transverse strut 39 via a further attachment device 53 on an inner side of the transverse strut 39, i.e., on a side facing away from the outer side 51. For example, the shaft 47 can include an external thread, and the attachment device 53 can be a nut that is screwed onto the shaft 47 against the transverse strut 39. The shaft 47 further includes a depression 55 concentric to its bore. The depression 55 has a depth that is slightly larger than an extension or a bore of the flange 49 as well as an extension of the transverse strut 39, but is shorter than the entire shaft 47, so that a stop 57 for an end of the spring element 43 results. The stop 57 here is disposed substantially perpendicular to an axis of rotation M of the manual drive shaft 45. An end of the spring element 43 opposing the stop 57 in the direction of the axis of rotation M is connected to the manual drive shaft 45 via a securing ring 59. In some further, not-depicted exemplary embodiments, the preload of the manual drive, so that the friction-fit of the drive shaft is separated, can also be effected in another manner.

FIG. 2B shows the situation when the manual drive 5 is not in friction-fit connection with a corresponding other bevel gear 61 of the drive shaft 25. The manual drive 5 is thus removed from a torque transmission path, via which a torque for changing the height H of the adjusting device 1 is transmitted when a drive torque is provided by the drive motor 3. The drive shaft 25 comprises the bevel gear 61 as a gear, which is disposed concentric to the drive shaft 25 and is disposed in the axial direction R between the drive motor 3 and the height-adjusting device 7 or between the coupling 37 and the drive motor 3. The manual drive 35 includes a polygon 63 on an end facing away from the bevel gear 41. Here this can be a hexagon, for example. Using a corresponding tool, the manual drive 5 or the bevel gear 41 can be rotated. Furthermore, in order to produce a friction-fit with the drive shaft 25 and to transmit the torque from the manual drive 5 to the drive shaft 25, the preload of the spring element 43 must be overcome. An operator can rotate, and press towards the drive shaft 25, the manual drive 5. In some further, not-depicted exemplary embodiments the manual drive can also include a grip and/or a crank.

Alternatively in some further, not-depicted exemplary embodiments, the manual drive can be preloaded such that the friction-fit with the drive shaft is effected via the preload. The manual drive or the bevel gear can be fixed to the platform against the force of the preload by a fixing device in order to separate the friction-fit.

In one operation mode of the adjusting device 1, which can be referred to, for example, as normal operation, the drive shaft 25 is driven by the drive motor 3 and the height H of the height-adjusting devices 7 and 9 is adjusted. For this purpose the drive shaft 25 rotates and engages with a not-depicted gear in the transmission 27 of the height-adjusting device 7, and the corresponding transmission of the height-adjusting device 9 in a corresponding gear on the hollow shafts 29 and 31 or the corresponding hollow shafts of the height-adjusting device 9. Depending on the direction of rotation, the threaded rods 33 and 35 are driven out from the hollow shafts 29 and 31 and the height-adjusting device 9 is also correspondingly adjusted such that a height H of the adjusting device 1 increases or lengthens. Here the individual tubes 19, 21, and 23 of the guide structures 11 and 13 are also moved apart telescopically. This state is depicted in a dashed manner in FIG. 1. Accordingly a height H of the adjusting device 1 can be reduced again by an opposite rotational movement of the drive shaft 25.

In another mode of operation of the adjusting device 1, which can be referred to as the manual-drive mode, the rotation of the drive shaft 25 is effected via the manual drive 5. For this purpose the manual drive 5 is brought into friction-fit (operative engagement) with the drive shaft 25. For this purpose the manual drive and the drive shaft can be coupled or connected to each other such that torque from the manual drive can be transmitted to the drive shaft. This can be effected by a direct coupling without the interposing of other transmission elements, or by an indirect coupling via further transmission elements. In the exemplary embodiment of the Figures, the gear wheel of the manual drive engages in an interference-fit manner in a gear wheel of the drive-shaft. By then rotating the manual drive 5, the torque from the manual drive 5 is transmitted to the drive shaft 25. In such cases, a brake, for example, an electromechanical brake, which is used to lock the drive shaft 25 when the motor is not used, must be released. The height-adjusting devices 7 and 9 are then adjusted (displaced) in the described manner via the drive shaft 25, as also in normal operation. In cases in which the motor 3 does not function for some reason, for example due to a power outage, the height H of the adjusting device 1 can thus be adjusted via the manual drive 5. The manual drive 5 offers the possibility to move the adjusting device 1 even without electrical energy.

In the adjusting device 1, a transmission wheel or a gear wheel, which can be moved with respect to the drive shaft 25, is thus added to the drive shaft 25 as a manual drive 5 in order to enter into a friction-fit with the drive shaft 25. This enables a conventional tool, for example, a wrench, to be used to upwardly or downwardly move the adjusting device 1 or the platform. In order to ensure that during a normal operation, i.e., when the drive motor 3 provides the drive torque, the second gear wheel is not in friction-fit or in engagement with the drive shaft 25, the spring element 43 or a spring is used that pulls biases the second gear wheel out of the friction-fit (engagement) of the main shaft or out of the movement region of the main shaft. Since the manual drive 5 is not in contact with the drive shaft 25, or is not in friction-fit with the drive shaft 25 via the drive motor 3 during the driving of the drive shaft 25, it can be prevented that the manual drive 5 also rotates or also moves. Thus, for example, the introduction of additional vibrations or the like or additional noise can be avoided or at least reduced.

Figure 3:
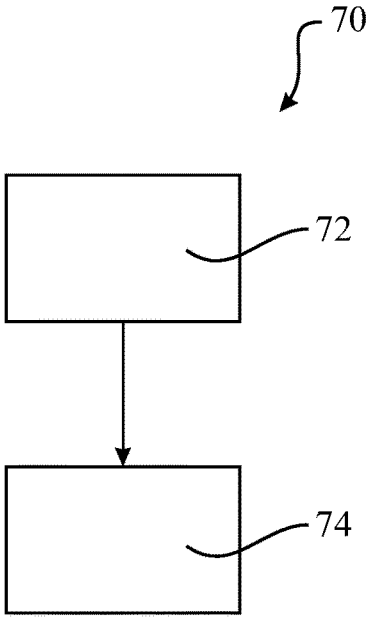
FIG. 3 shows a schematic depiction of a method for changing the height of the platform.

FIG. 3 shows a schematic depiction of a method 70 for changing a height of a platform, which can be embodied, for example, with the adjusting device 1. In other exemplary embodiments the method 70 can also be embodied with another adjusting device.

In the method 70 a motor-driven adjusting of a height of the platform using a drive motor occurs in a process 72. Further, a manual adjusting of a height of the platform using a manual drive occurs in a process 74. Here the processes 72 and 74 can be carried out in different orders. The process 74 can possibly also be omitted. For example, if the platform has been motor-driven into an elevated position and then the power fails, a non-motor-driven adjusting using the manual drive to lower the platform can subsequently occur. In other cases, for example, if a height of the platform or of the adjusting device is to be increased without power or without the drive, this can be effected manually using the manual drive. If power is then available again later, the reducing of the height of the adjusting device can be effected in a motor-driven manner. The increasing of a height of the adjusting device can also be effected partially in a motor-driven manner and partially using the manual drive. Likewise the decreasing of a height of the adjusting device can also be effected partially manually and partially using the drive motor.

The adjusting device 1, a platform including the adjusting device, or the method 70 can, as described for the Figures, be used in all possible medical applications, for example, for the adjusting of couches, beds, patient tables, or the like. The adjusting device can be used, for example, as a lifting unit for a medical table. Such applications can be, for example, all possible applications or examinations, in particular, X-ray applications or examinations, CT, CRT, MRT, and/or MRI examinations. In order to increase comfort for a patient and/or also for an operator, it is important in such applications that only slight noise and slight-as-possible vibrations occur. However, the adjusting device 1 and the method 70 can also be used other than as described for the exemplary embodiments of the Figures, in all possible other applications and fields of use, such as, for example, in manufacturing, for assembly purposes, or the like.

The exemplary embodiments and their individual features disclosed in the above description, the following claims, and the accompanying Figures can be meaningful and implemented both individually and in any combination for the realization of an exemplary embodiment in its various designs.

In some further exemplary embodiments, features that are disclosed in other exemplary embodiments as device features can also be implemented as method features. Furthermore, features that are implemented in some exemplary embodiments as method features can also optionally be implemented in other exemplary embodiments as device features.

REFERENCE NUMBER LIST

1 Adjusting device
3 Drive motor
5 Manual drive
7 First height-adjusting device
9 Second height-adjusting device
11 First guide structure
13 Second guide structure
15 Base plate
17 Platform plate
19 Tube of largest cross-section
21 Tube of medium cross-section
23 Tube of smallest cross-section
25 Drive shaft
27 Transmission
29 Hollow shaft
31 Hollow shaft
33 Threaded rod
35 Threaded rod
37 Coupling
39 Transverse strut
41 Bevel gear
43 Spring element
45 Manual drive shaft
47 Shaft
49 Flange
51 Outer side
53 Attachment device
55 Depression
57 Shoulder
59 Securing ring
61 Bevel gear
63 Polygon
71 Method
72 Process
74 Process
H Height of Adjustment-device
R Drive-shaft axis of rotation
M Manual-drive axis of rotation

We claim:

1. An apparatus for changing a height of a height-adjustable platform relative to a support surface, the apparatus comprising:

a rotatable drive shaft configured to actuate a first height-adjusting device and a second height-adjusting device to change a height of an end of the first height-adjusting device relative to the support surface and a height of an end of the second height-adjusting device relative to the support surface;

at least one drive motor operably connected to the rotatable drive shaft for rotating the rotatable drive shaft; and at least one manual drive for driving the rotatable drive shaft, the at least one manual drive comprising a first gear configured to engage a second gear of the rotatable drive shaft such that torque is transmissible from the manual drive to the rotatable drive shaft, wherein the at least one manual drive is shiftable between a first configuration and a second configuration, the first configuration comprises when the at least one manual drive operably engages via the first gear to the second gear the rotatable drive shaft, the second configuration comprises when the at least one manual drive is disengaged from the rotatable drive shaft, wherein the at least one manual drive comprises a retaining means for holding the at least one manual drive in the second configuration, wherein the second gear of the rotatable drive shaft is fixed to a platform against a force of a preload by a fixing device to separate a friction-fit.

2. The apparatus according to claim 1, wherein the at least one manual drive is configured to selectively operably engage the rotatable drive shaft.

3. The apparatus according to claim 2, wherein the at least one manual drive is configured to be selectably coupled to the rotatable drive shaft via a friction fit or an interference-fit.

4. The apparatus according to claim 3, wherein the gear of the at least one manual drive comprises a first bevel gear and the gear of the rotatable dive shaft comprise a second bevel gear, wherein the first bevel gear is configured to engage the second bevel gear such that torque is transmissible from the at least one manual drive to the rotatable drive shaft.

5. The apparatus according to claim 4, wherein the manual drive is shiftable between a first configuration in which the at least one manual drive operably engages the rotatable drive shaft and a second configuration in which the at least one manual drive is disengaged from the rotatable drive shaft and including a spring configured to bias the at least one manual drive toward the second configuration, wherein an axis of rotation of the at least one manual drive is disposed at an angle of about 90° to the drive shaft, and wherein the first height-adjusting device comprises a threaded shaft and a ball screw.

6. The apparatus according to claim 2, wherein the retaining means comprises a spring configured to bias the at least one manual drive toward the second configuration.

7. The apparatus according to claim 2, wherein an axis of rotation of the at least one manual drive is disposed at an angle of about 90° to the rotatable drive shaft.

8. The apparatus according to claim 3, wherein the first height-adjusting device comprises a threaded shaft and a ball screw.

9. The apparatus according to claim 1, wherein the gear of the at least one manual drive is friction-fit to engage the gear of the rotatable drive shaft.

10. A height-adjustable platform including:

a base plate;

a platform plate; and the apparatus according to claim 1 connected to the base plate and to the platform plate and configured to change the position of the platform plate relative to the base place.

11. A platform according to claim 10, wherein the at least one manual drive is supported by the base plate.

12. An apparatus for changing a height of an adjustable height platform relative to a support surface, the apparatus comprising:

a rotatable drive shaft configured to actuate a first height-adjusting device and a second height-adjusting device to change a length of the first height-adjusting device and a length of an end of the second height-adjusting device, a motorized drive operably connected to the rotatable drive shaft; and a manual drive selectively operably connected to the rotatable drive shaft, wherein the apparatus is shiftable between a first mode of operation in which the rotatable shaft is driven by the motorized drive and a second mode of operation in which the rotatable shaft is driven by the manual drive; and at least one manual drive for driving the rotatable drive shaft, the at least one manual drive comprising a first gear configured to engage a second gear of the rotatable drive shaft such that torque is transmissible from the manual drive to the rotatable drive shaft, wherein the at least one manual drive is shiftable between a first configuration and a second configuration, the first configuration comprises when the at least one manual drive operably engages via the first gear to the second gear the rotatable drive shaft, the second configuration comprises when the at least one manual drive is disengaged from the rotatable drive shaft, wherein the at least one manual drive comprises a retaining means for holding the at least one manual drive in the second configuration, wherein the second gear of the rotatable drive shaft is fixed to a platform against a force of a preload by a fixing device to separate a friction-fit.

13. The apparatus according to claim 12, wherein the gear of the at least one manual drive comprises a first bevel gear and the gear of the rotatable dive shaft comprise a second bevel gear, wherein the first bevel gear is configured to engage the second bevel gear such that torque is transmissible from the at least one manual drive to the rotatable drive shaft.

14. The apparatus according to claim 12, wherein the first and second height-adjusting devices each comprise a threaded shaft and a ball screw.

* * * * *